US007009586B2

(12) United States Patent
Akiba

(10) Patent No.: US 7,009,586 B2
(45) Date of Patent: Mar. 7, 2006

(54) METHOD FOR DRIVING PLASMA DISPLAY PANEL

(75) Inventor: Yutaka Akiba, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 142 days.

(21) Appl. No.: 10/327,982

(22) Filed: Dec. 26, 2002

(65) Prior Publication Data

US 2003/0122742 A1 Jul. 3, 2003

(30) Foreign Application Priority Data

Dec. 27, 2001 (JP) ..... 2001-397696

(51) Int. Cl.
*G09G 3/28* (2006.01)

(52) U.S. Cl. ..... 345/63; 345/60; 315/169.4; 348/797; 313/484

(58) Field of Classification Search ..... 345/60, 345/63, 66–68, 205, 208, 210; 315/169.4; 313/581, 582, 484; 348/797
See application file for complete search history.

(56) References Cited

U.S. PATENT DOCUMENTS

| | | | | |
|---|---|---|---|---|
| 5,920,295 | A * | 7/1999 | Takahashi et al. | 345/60 |
| 6,232,935 | B1 * | 5/2001 | Fukushima et al. | 345/67 |
| 6,373,451 | B1 * | 4/2002 | Kang et al. | 345/60 |

FOREIGN PATENT DOCUMENTS

| | | |
|---|---|---|
| EP | 1-071068 | 1/2001 |
| JP | 11-312470 | 11/1999 |
| JP | 2000-306516 | 11/2000 |

OTHER PUBLICATIONS

"All About Plasma Display", Kogyou Chousakai Publishing Co., Ltd., pp. 154-159.

* cited by examiner

*Primary Examiner*—Lun-Yi Lao
*Assistant Examiner*—Tom Sheng
(74) *Attorney, Agent, or Firm*—Mattingly, Stanger, Malur & Brundidge, P.C.

(57) ABSTRACT

A driving method enables an improvement in emission efficiency and achievement of a higher degree of brightness when employing the address while display driving (AWD) scheme. Taking a 3-bit 8-gradation display as an example, a first H period (one horizontal scan period) of each subfield is divided into 3 regions (first region, second region, and third region in the order of time), and, in each of the lines, an address period (address pulse $P_A$ and scan pulse $P_{AY}$) of the subfield SF1 is set in the first region, an address period of subfield SF2 is set in the second region, and an address period of the subfield SF3 is set in the third region. The regions other than those in which the address period is set are used as the sustain period, and a time length of each sustain pulse $P_s$ is set to ⅓ of the length of the H period. A reset period achieved by a reset pulse $P_R$ and a priming period achieved by a priming pulse $P_P$ are set in the region where the address period is set.

11 Claims, 7 Drawing Sheets

PRIOR ART FIG. 10
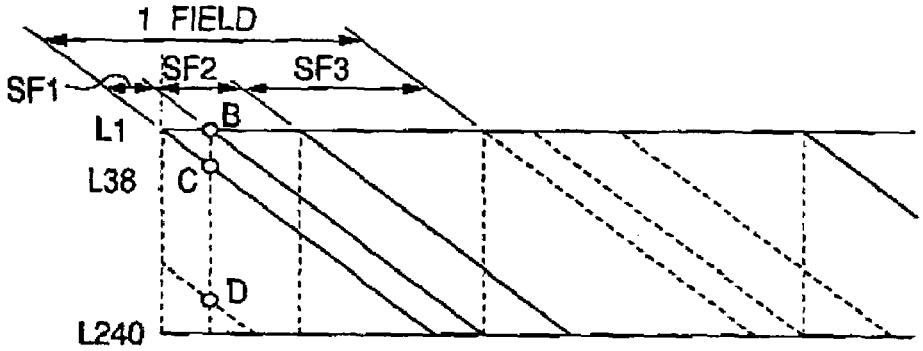
PRIOR ART FIG. 11
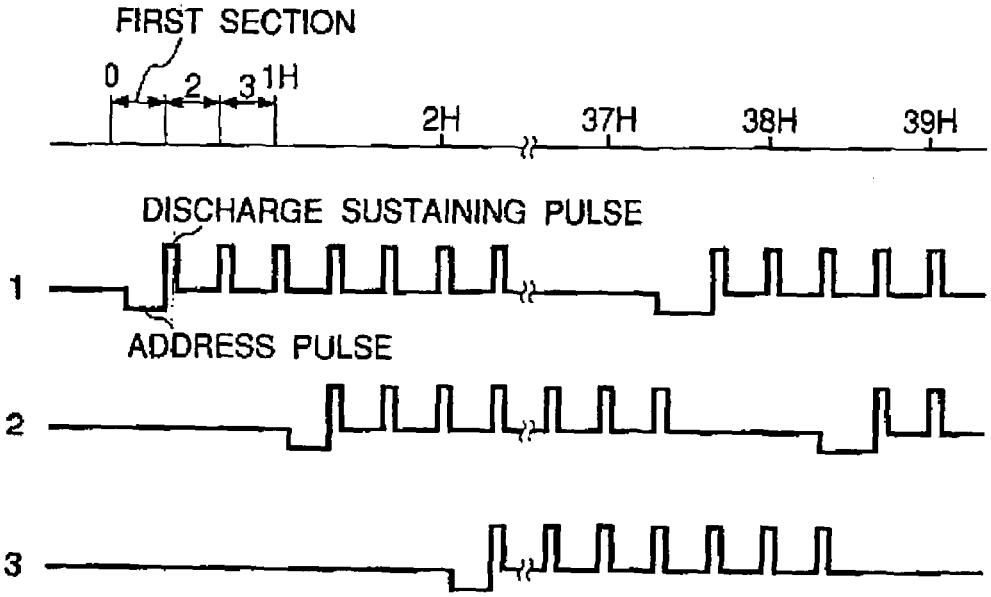

METHOD FOR DRIVING PLASMA DISPLAY PANEL

BACKGROUND OF THE INVENTION

1. Field of the Invention

The present invention relates to a method for driving a plasma display panel which performs gradation display and, particularly, to a method for driving the plasma display panel using an address while display driving (AWD) scheme.

2. Description of the Prior Art

Plasma display panels having configurations shown in FIGS. 7A to 7C have heretofore been proposed. Each of FIGS. 7A and 7C is a sectional view showing a portion of the plasma display panel for one cell, wherein a transparent front substrate 1, a back substrate 2, partitions 3, a Y electrode 4, an X electrode 5, an address electrode 6, a phosphor 7, and a discharge space 8 are shown.

As shown in FIGS. 7A to 7C, each of the plasma display panels has the structure wherein the front substrate 1 is coupled with the back substrate 2 in an integrated fashion with the partitions 3 being sandwiched therebetween, and the discharge space 8 is defined by the partitions 3 between the front substrate 1 and the back substrate 2. In the plasma display panel having the configuration shown in FIG. 7A, the front substrate 1 is provided with the X electrode 5 and the Y electrode 4 which is parallel with the X electrode 5, and the back substrate 2 is provided with the address electrode 6 which is perpendicular to the display electrodes 4 and 5. The phosphor 7 is placed on surfaces of the, partitions 3 and inside the back substrate 2. In the plasma display panel having the configuration shown in FIG. 7B, the front substrate 1 is provided with the X electrode 5, which is one of a pair of the display electrodes, and the back substrate 2 is provided with the Y electrode 4 which is parallel with the X electrode 5 and which pairs off with the X electrode 5. The back substrate 2 is also provided with the address electrode 6 which is perpendicular to the display electrodes 4 and 5. The phosphor 7 is placed on the surfaces of the partitions 3 each of which is covered with an insulating film (not shown). In the plasma display panel having the configuration shown in FIG. 7C, the back substrate 2 is provided with the X electrode 5 and the Y electrode 4 which are in parallel with each other as well as the address electrode 6 which is perpendicular to the display electrodes 4 and 5. The back substrate 2 is further provided with a partition 9 which is formed between the partitions 3 in such a fashion as to project into the discharge space 8, the partition 9 being integrated with the partitions 3. The X electrode 5 is placed on the back substrate 2 in such a fashion as to face a space defined between one of the partitions 3 and the partition 9, while the Y electrode 4 is placed on the back substrate 2 in such a fashion as to face a space defined between the other partition 3 and the partition 9.

FIG. 8 is a diagram showing wiring patterns of the electrodes 4, 5, and 6, wherein a cell is denoted by 10 and the electrodes which are shown in FIGS. 7A to 7C are denoted by the same reference numerals. Only 4×4 cells are shown in FIG. 8 for brevity, and each of the cells 10 is drawn with the dotted lines.

In FIG. 8, the X electrode 5 and the Y electrode 4 extend along an alignment (hereinafter refereed to as "line") of the cells 10 in the horizontal (h) direction, and each of the lines is provided with the X electrode 5 and the Y electrode 4. Voltages are applied respectively to the Y electrodes 4 to drive them, but, since the X electrodes 5 are common display electrodes, a voltage is applied to the X electrodes 5 to drive them at a time. The address electrode 6 extends along an alignment of the cells 10 in the vertical (v) direction, and each of the vertical cell alignments is provided with the address electrode 6. Voltages are applied respectively to the address electrodes 6 to drive them.

Referring to the plasma display panels shown in FIGS. 7A to 7C, discharges each having intensity responsive to a specified gradation occur in the cells which are chosen to be lit in each of field periods to thereby cause visible light emissions in the cells at the intensities responsive to the gradation. A choice of a lighting cell or an unlighting cell is performed by applying voltages to the Y electrode 4 and the address electrode 6, thereby forming a wall charge near the Y electrode 4. In the cell where the wall charge is formed so as to produce a forward bias wall voltage, a discharge occurs along a discharge passage indicated by the dotted arrow between the Y electrode 4 and the X electrode 5 due to voltages applied alternately to the Y electrode 4 and X electrode 5. The discharge causes a generation of ultraviolet rays, and the phosphor 7 is excited by the ultraviolet rays to emit the visible light.

Driving schemes for achieving gradation display in plasma display panels include an address display separation driving scheme and an address while display driving scheme. In both of the schemes, the gradation is represented as follows:

$$a_0 \cdot 2^0 + a_1 \cdot 2^1 + a_3 \cdot 2^3 \ldots + a_n \cdot 2^n,$$

wherein n is an integer, and $a_i$=0 or 1 (i=0, 1, . . . , n). That is, the gradation is represented by n bit. In the case of 8 bits, for example, 0 to 255 ($2^8$=256) gradations are displayed.

In the case of 8-bit gradation display employing the address display separation driving scheme, one field is divided into 8 subfields $SF_1$ to $SF_8$, and each of the subfields $SF_j$ (j=1, 2, . . . , 8) is divided into a priming/address period and a sustain period. Lengths of the priming/address period in the subfields $SF_j$ are identical to one another, and lengths of the sustain periods of the subfields $SF_j$ are in the ascending order of $SF_1$, $SF_2$, . . . , and $SF_8$, i.e., in such a manner as to satisfy a ratio of $SF_1$:$SF_2$:$SF_3$:$SF_4$:$SF_5$:$SF_6$:$SF_7$:$SF_8$ to be:

$$1:2:4:8:16:32:64:128 \quad (1)$$

Here, in each of the sustain periods of the subfields $SF_j$, sustain pulses are supplied alternately to the Y electrode 4 and X electrode 5 (see FIGS. 7A to 7B) on a fixed cycle to thereby generate discharges for light emissions. Accordingly, the number of supplied sustain pulses, i.e., the number of light emissions, and an amount of the light emissions are increased with the increase in the length of the sustain period in subfields $SF_j$ as shown in ratio (1). A picture having the 0 to 255 gradations is displayed by properly designating the subfields $SF_j$ to emit light.

The priming/address period is a sort of preparation period for performing the light emission. For example, in the plasma display panels having the configurations shown in FIGS. 7A to 7C, wall charges (wall voltages) are formed on the Y electrode 4 and the address electrode 6 in each of the cells by application of a pulse (priming pulse) having a predetermined voltage (a voltage pulse is also applied to the address electrode 6 simultaneously with the application of the voltage pulse to the Y electrode 4 in some cases), and this operation is referred to as "priming". The priming is performed for each of the cells at a time. After the priming, an address discharge is produced by applying a scan pulse and an address pulse, which are opposite in polarity, to the Y electrode 4 and the address electrode 6 in order to achieve a forward bias, the Y electrode 4 being used also as a scan electrode and the address electrode 6 extending on a cell to be lit. Owing to the thus-produced address discharge, a wall charge to be formed on the Y electrode 4 of the cell to be lit has a polarity required for sustaining the discharge in the lighting cell. This is an addressing for choosing the lighting cell. When choosing an unlighting cell, the choice is made in the same manner as in the choice of lighting cell although a required polarity is different from that of the lighting cell.

In the plasma display panel having the configuration shown in FIG. 7A, each of the partitions 3 is formed from a dielectric, and a negative glow discharge is used as a discharge scheme in the case of a short gap length. Such plasma display panel has a problem that the dielectric of the partition 3 inhibits the formation of a positive column generated by the glow plug if the gap length is lengthened. The plasma display panel having the configuration shown in FIG. 7B wherein each of the partitions 3 is a metal partition (Japanese Patent Laid-open No. 11-312470) and a plasma display panel having the configuration shown in FIG. 7C (Japanese Patent Laid-open No. 2000-306516) have been proposed in order to solve the above problem. In each of the plasma display panels of FIGS. 7B and 7C, since the discharge passage indicated by the dotted arrow is satisfactorily long as compared with the plasma display panel of FIG. 7A, an efficient positive column is formed and a coating area of the phosphor is enlarged to increase the amount of light emission, thereby realizing a high degree of emission efficiency. Further, there have been proposed a plasma display panel which is improved in the emission efficiency and realizes a high degree of brightness by producing narrow pulse discharges between the display electrode 4 and the metal partition 3 and between the display electrode 5 and the metal partition 3 in place of using the positive column mode of the glow discharge.

In the above-described plasma display panels, intensity of light emission is increased with an increase in the sustain period which contributes to the light emission. A proportion of the sustain period to one field period is usually referred to as "duty ratio of light emission", and the duty ratio of light emission of the above plasma display panels employing the address display separation driving scheme is the following value (Shigeo Mikoshiba and Heiju Uchiike "All about Plasma Display" Kogyou Chousakai Publishing Co., Ltd. pp. 154–155.

More specifically, the time required as an address period for obtaining a sufficient wall charge is about 3 μsec. The priming is performed for all the cells at a time; however, the addressing is performed for each of the lines sequentially and, therefore, the time required for addressing all the lines if the number of lines in a plasma display panel is 480, for example, is:

$$480\times 3\ \mu\text{sec}=1.44\ \text{msec}.$$

This is the time length of the address period in one subfield. In the case of 8-bit 256-gradation display, the total time length of address periods in one field becomes 11.52 msec because each of the fields consists of 8 subfields. Accordingly, in view of the time length of one field of 16.7 msec, the time length of sustain period in one field is:

$$16.7\ \text{msec}-11.52\ \text{msec}=5.18\ \text{msec},$$

and this means that a proportion of the sustain period to the time length of one field, i.e. the duty ratio of light emission, is as small as 31%.

Further, the inventors of the present invention have conducted an experimental manufacture of a plasma display panel wherein the metal partitions were used as the partitions 3 (see FIGS. 7B to 7C), and the above-described narrow pulse discharge was performed using the plasma display panel. The experiment has revealed a problem that a space charge is increased cumulatively in the discharge space 8 (see FIGS. 7B to 7C) due to the narrow pulse discharge to deteriorate intensity of an electric field which is formed between the display electrodes 4 and 5, thereby impeding improvement in the emission efficiency. It has also been found that lengthening of a cycle of repeating sustain discharges in a sustain period and reduction of the space charge by sufficient neutralization are effective for the prevention of the problem; however, the lengthening of the cycle requires a reduction in the number of sustain discharges in the sustain period, which causes deteriorations in the duty ratio of light emission and the brightness. Thus, it has been confirmed that the lengthening of the repeating cycle of the sustain discharges in the address display separation driving scheme is considerably difficult from the practical standpoint.

As compared with the address display separation driving scheme (ADS), it is possible to maintain a duty ratio of light emission of 90% or more in the address while display driving scheme (AWD). Therefore, it is possible to lengthen the cycle of repeating sustain discharges in the sustain period. The AWD will be described below based on the above-mentioned literature "All About Prism Display".

In the case of 3-bit 8-gradation display, one field is divided into 3 subfields, and a first H period of each of the subfields (H means a scan period for one line, i.e., one horizontal scan period (=63.5 μsec)) is used as the priming period. Here, a ratio among the subfield SF1 of the bit 1, the subfield SF2 of the bit 2, and the subfield SF3 of the bit 3 should be 1:2:4 in view of ratio (1), a length of the subfield SF1 is:

$$262.5H\div(1+2+7)=37H \text{ with the remainder of } 3.5H \qquad (2).$$

Thus, a length of the subfield SF2 is set to 74H (37H×2), and a length of the subfield SF3 is set to 148H (37H×4). In addition, if the following equation is satisfied, $$262.5H-(37H+74H+148H)=3.5H$$

and the subfields SF1 to SF3 are each set as described above, the remainder of 3.5H; however, this is ignored because it is only 1.3% of one field.

Shown in FIG. 10 are driving timings for achieving the 3-bit 8-gradation display, wherein a time axis (lower one), which uses the line 1 as the reference line and an H period as the unit, and subfield periods (upper one) are used to enter the horizontal axis, while lines from the line L1 to the line L240 are used to enter the vertical axis.

In FIG. 10, a subfield SF1 of the line L1 consists of 37H (0H to 36H), and the first period, which is 0H, is set to be an address period A. A subfield SF2 consists of 74H (37H to 110H), and the first period 37H is used as the address period. A subfield SF3 consists of 148H (111H to 258H), and the first period 111H is used as the address period. Timings in the line L2 are such that the timings for the subfields SF1 to SF3 of the line L1 are respectively delayed by one H period, and timings in the line L3 are such that the timings for the line L2 are respectively delayed by one H period. That is, the timings are respectively delayed by one H period and, therefore, the address periods are respectively shifted by one H period with the increase in the line number.

An address period B of the subfield SF2 of the line L1 falls on 37H, and an address period C of the subfield SF1 of the line L38 falls on the same period 37H. In the succeeding lines, up to line L240, an address period D of a subfield SF3 of a line L112 of a preceding field falls on the same period. This means that the address periods B, C, and D of three lines are overlapped in one period. Such phenomenon occurs repeatedly with the lapse of time.

However, the addressing cannot be performed for a plurality of lines at a time. Therefore, one H period, which is used as one address period in the above example, is divided into three periods of a first region, a second region, and a third region as shown in FIG. 11, and, in each of the lines, the first region is used as an address period of a subfield SF1 of a bit 1, the second region is used as an address period of a subfield SF2 of a bit 2, and the third region is used as an address period of a subfield SF3 of a bit 3. In FIG. 10, for example, a first region of 37H is used as an address period of the subfield SF1 of the line 38, a second region of 37H is used as an address period of the subfield SF2 of the line L1, and a third region of 37H is used as an address period of the subfield SF3 of the line L112. Thus, even if it is necessary to perform the priming/addressing operations for a plurality of lines in one H period, it is possible to vary the timings for them.

Further, according to the above driving scheme, it is possible to use the period (2H/3) other than the address period in the first H period in each of the subfields of each of the lines as a sustain period.

The foregoing is a description of the address period, and, in general, a reset period for removing a wall charge from the Y electrode 4 (see FIGS. 7A to 7C) in each of the cells as well as a priming period for forming a wall charge having a predetermined polarity on the Y electrode 4 (in some cases, a wall charge may be formed also on the address electrode 6 at the same time) are usually precedent to the address period. The Y electrodes 4 for the respective lines are independently driven, and one H period precedent to the H period which is used as the address period or an aH period ($a \geqq 2$) having a time length of aH (a is a positive integer) is used as the reset period and the priming period. Further, the reset and the priming may sometimes be performed in the address period or an H/3 period.

The foregoing is a description of the 3-bit 8-gradation display. In the case of the 8-bit 256-gradation display, 8 subfields in the ratio represented by ratio (1) are set for each of fields. A first H period in each of the subfields is divided into 8 regions. An address period is set in one of the regions of each of the subfields with a delay of one region per subfield in such a manner that the first region of the subfield SF1 is used as the address period and the eighth region of the subfield SF8 is used as the address period. Also in this case, it is possible to use a period (7H/8 period) other than the address period in the first H period as the sustain period. Further, one H period preceding the H period which is used as the address period is used for performing the reset and the priming in this case; however, a period having a time length of aH (a is integer and 2 or more) is used for forming a sufficient wall charge from a space charge formed after the reset. If the reset period and the priming period can be shortened, the reset and the priming may sometimes be performed in H/8 period of the address period.

According to the above driving method, the sustain period is a period having a time length obtained by subtracting the reset period and the priming period of the first H period of each of the subfields, the address period of H/3 period subsequent to the fist H period, and the remainder period of 3.5H from one field period. In the case of the 3-bit 8-gradation display, a total of the periods other than the sustain periods is approximately:

$$(1H+H/3)\times 3+3.5=7.5H,$$

which means that the duty ratio of light emission is about 97%.

Since it is possible to increase the duty ratio of light emission as described above, the repeating cycle of the sustain discharges in the sustain period can be increased. As shown in FIG. 11, which is an example of the increased repeating cycle in the case of the 3-bit 8 -gradation display, the repeating cycle is $T_H/3$ ($T_H$ is a cycle of horizontal scan periods). In the case of the 8 bit 256-gradation display, it is possible to set the repeating cycle to $T_H/8$. That is to say, it is possible to set the repeating cycle to $T_H/n$ in the case of n-bit gradation display. Further, in accordance with the relationship between the address periods and the sustain periods, it is possible to set a time length of the repeating cycle to be $aT_H/n$ (a is a positive integer) or $(T_H/n)/a$ (a is a positive integer). Thus, the repeating cycle has a considerably high degree of freedom while it may be discrete.

As described above, although the address while display driving scheme realizes the improvement in the duty ratio of light emission, the lengthened repeating cycle of sustain discharges in a sustain period even in high-gradation display, and the prevention of cumulative increase of space charges which are generated when employing the narrow pulse discharge method, 2H periods cannot be used as the sustain period in each of the subfields when the scheme is employed because one H period is used for each of the reset/priming and the addressing in each of the subfields in the scheme. If the time required for each of the reset/priming and the addressing is shortened, it is possible to lengthen the sustain period and to further increase the duty ratio of light emission, thereby further improving the emission efficiency.

SUMMARY OF THE INVENTION

The present invention has been accomplished in view of the above demands, and an object thereof is to provide a method for driving a plasma display panel capable of improving an emission efficiency and realizing a higher degree of brightness when the address while display driving scheme is employed.

In order to achieve the above object, the present invention provides a method for driving a plasma display panel which realizes n-bit gradation display by: dividing each of fields in each of lines into n subfields (n is a positive integer); dividing a first H period (H is a horizontal scan period) in each of the subfield into n equal regions; setting an address period in one of the regions in each of the subfields, the regions used as the address period being different in order (first to n-th) from one another; and setting a cycle of sustain pulses in a sustain period which is subsequent to the region in which the address period is set to a time length which is m/n times that of one H period (m is a positive integer), wherein, in each of the subfields, a priming period precedent to the address period is set in any one of the region in which the address period is set, an H period precedent to that used as the address period, and a period having a time length of aH (a is a positive integer).

A reset period for removing a wall charge from one of display electrodes is set in any one of a period which is precedent to the priming period and in the region where the address period is set, an H period precedent by one H period to the H period which is used as the address period, and a period precedent to the priming period and having a time length of aH (a is a positive integer), and a voltage of a reset pulse in the reset period is set to a level larger in a specific one of the subfields than those in the other subfields in each of the fields.

A priming pulse in the priming period has a waveform that is continuous from a waveform of the reset pulse.

A positive voltage pulse is applied to one of the display electrodes during a period of application of a sustain pulse to the other display electrode in the sustain period.

A pulse width of the sustain pulse is set to a width shorter than that of an address pulse in the address period.

BRIEF DESCRIPTION OF THE DRAWINGS

FIG. 10 is a diagram showing a configuration of one field in a plasma display panel employing the address while display driving scheme; and FIG. 11 is a diagram showing timings for addressing a plurality of lines in the address while display scheme.

DESCRIPTION OF THE PREFERRED EMBODIMENTS

Figure 7A:
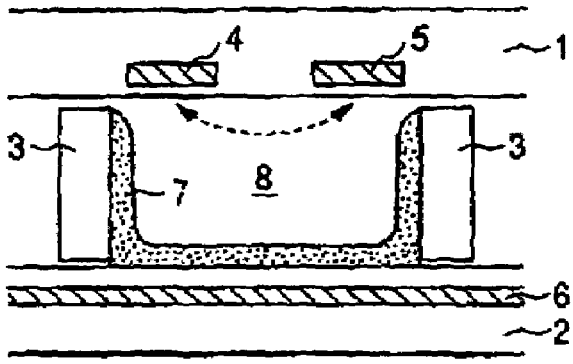
PRIOR ART FIG. 7A
FIG. 7A is a diagram showing a configuration of a plasma display panel.
Figure 7B:
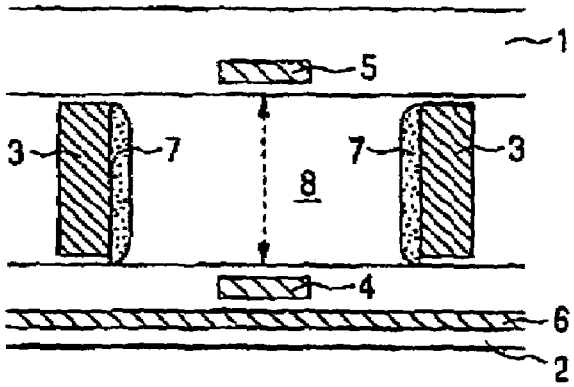
PRIOR ART FIG. 7B
FIG. 7B is a diagram showing a configuration of another plasma display panel.
Figure 7C:
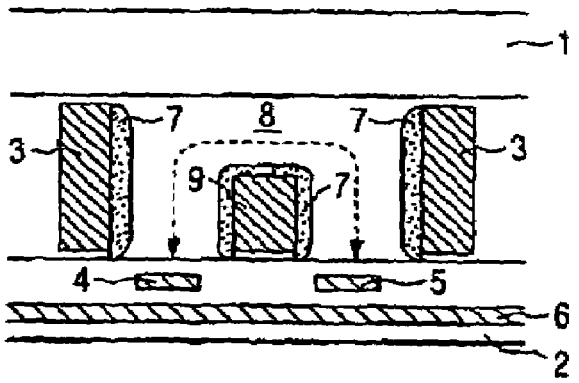
PRIOR ART FIG. 7C
FIG. 7C is a diagram showing a configuration of another plasma display panel.
Figure 8:
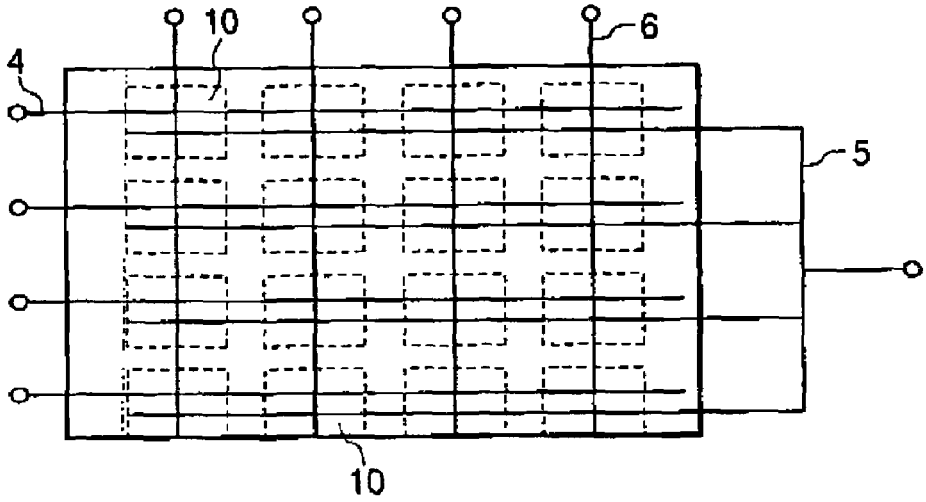
PRIOR ART FIG. 8
FIG. 8 is a diagram showing wiring patterns of the electrodes shown in FIGS. 7A to 7C.
Figure 9:
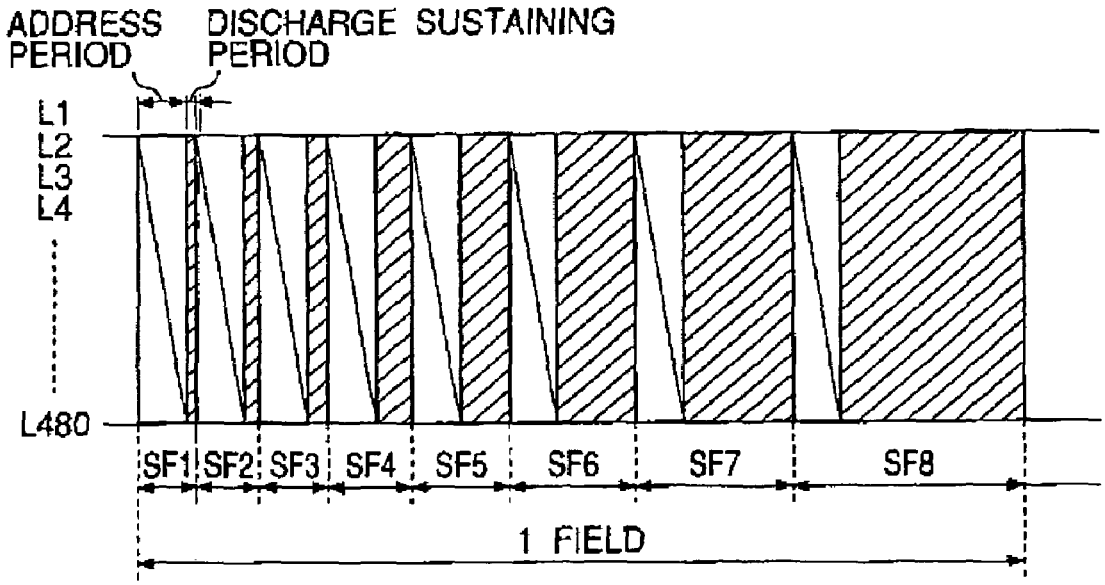
PRIOR ART FIG. 9
FIG. 9 is a diagram showing a configuration of one field in a plasma display panel employing the address display separation driving scheme.

Plasma display panels to which the present invention is to be applied have such a configuration that two display electrodes (X electrode 5 and Y electrode 4) are placed opposite to each other across a discharge passage which is formed of partitions 3 and 9 as shown in FIGS. 7B and 7C, and a narrow pulse discharge scheme is employed as a discharge scheme in the plasma display panels. In the narrow pulse discharge scheme, a high-intensity electric field is produced by rendering a potential difference between each of the display electrodes (Y electrode 4 and X electrode 5) and the metal partition 3. The metal partition 3 serves normally as an anode electrode owing to an applied voltage of 0V, while each of the Y electrode 4 and the X electrode 5 serves as a cathode electrode owing to a negative voltage which is applied alternately thereto (the Y electrode 4 and the X electrode 5 serve as anode electrodes when no negative voltage is applied thereto), so that a discharge occurs between the display electrode to which the negative voltage is applied and the metal partition 3. Such discharge is hardly achieved in the plasma display panel having a configuration shown in FIG. 7A as compared with those having the improved configurations of FIGS. 7B and 7C wherein the high-intensity electric field is produced. Since the high-intensity discharge is generated and erased in a short time, ultraviolet rays having high intensity are generated by the discharge to enhance a discharge efficiency (emission efficiency) as well as to achieve a high degree of brightness.

However, in the address display separation driving scheme described above, space charges are accumulated in a discharge space 8 (see FIGS. 7B and 7C) to decrease an amount of a wall charge when the narrow pulse discharge scheme is employed. In order to prevent the decrease in wall charge, the address while display driving scheme shown in FIGS. 10 and 11, which enables to lengthen a cycle of repeating discharges in a sustain period is employed in the present invention.

Hereinafter, embodiments of the present invention will be described with reference to the accompanying drawings.

Figure 1:
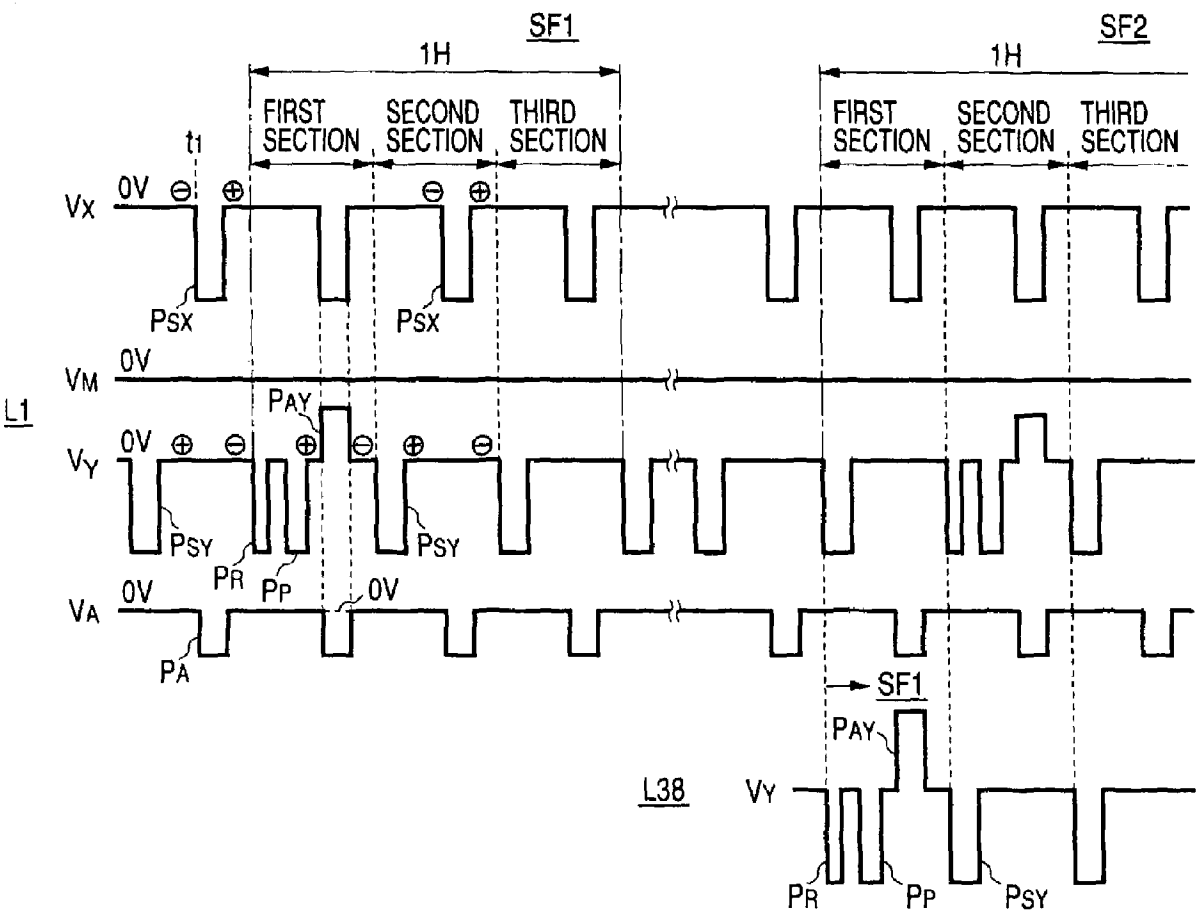
FIG. 1 is a diagram showing timings in a method for driving a plasma display panel of a first embodiment according to the present invention.

FIG. 1 is a diagram showing timings in a method for driving a plasma display panel of a first embodiment according to the present invention. In FIG. 1, first H periods of subfields SF1 and SF2 in one line (line L1) are illustrated, where $P_A$ represents an address pulse; $P_{AY}$ represents a scan pulse; $P_{SX}$ and $P_{SY}$ represent sustain pulses; $P_R$ represents a reset pulse; and $P_P$ represents a priming pulse.

Taking the plasma display panel having the configuration shown in FIG. 7B as an example, sustain pulses $P_{SX}$ and $P_{SY}$ of negative voltages (represented by $V_Y$ and $V_X$) are applied alternately to the Y electrode 4 and the X electrode 5 at a regular interval throughout one field period except the first H periods of the subfields in FIG. 1. If the negative sustain pulse $P_{SX}$ is applied to the X electrode 5 to make it an cathode electrode and the applied voltage to the Y electrode 4 is maintained at 0V to make it an anode electrode in a state where a negative wall charge and a positive wall charge are formed on the X electrode 5 and the Y electrode 4 at the time t1, a high-intensity electric field is generated between the X electrode 5 and the metal partition 3, which serves as an anode electrode as being maintained at 0V, and a discharge occurs therebetween when the electric field intensity exceeds a predetermined degree. Following the discharge between the X electrode 5 and the metal partition 3, a high-intensity discharge (about 200 msec) is produced instantly between the X electrode 5 and the Y electrode 4. Thus, high-intensity ultraviolet rays are generated to excite the phosphor 7, thereby causing an emission of visible light.

A positive wall charge and a negative wall charge are formed on the X electrode 5 and the Y electrode 4, respectively, due to the discharge, and, when the negative sustain pulse $P_{SY}$ is applied to the Y electrode 4 in this state, a sustain discharge occurs between the electrodes 4 and 5 in the same manner as described above so that the visible light is emitted from the phosphor 7.

Thus, the discharge between the display electrodes 4 and 5 is sustained by the sustain pulses which are applied alternately to the X electrode 5 and the Y electrode 4, thereby enabling the emission from the phosphor 7 to be sustained.

Here, in the case of 3-bit 8-gradation display, each of first H periods of subfields SF1 to SF3 is divided into three regions of a first region, a second region, and a third region, in the order of time. An address period is usually set in each of the first region of the subfield SF1, the second region of the subfield SF2, and the third region of the subfield SF3, but, in the present embodiment, a period for reset and priming which are performed in advance of the addressing is included in the region in which the address period is set. The sustain pulses of an H/3 cycle, which are represented by voltages $V_X$ and $V_Y$, respectively, are alternately applied to the X electrode 5 and the Y electrode 4. The cycle may be lengthened to a time length of aH/3 (a is an integer) by applying the sustain pulses at the same timing.

Referring to the subfield SF1, which is the first subfield in the line L1, the address period is set in the first region of the first H period. The negative address pulse $P_A$ (whose voltage is represented by $V_A$) is applied to an address electrode 6 on the same cycle with and in phase synchronization with the sustain pulse $P_{SX}$ of the X electrode 5, and the positive scan pulse $P_{AY}$ is applied to the Y electrode 4 at the same timing with that of the address pulse $P_A$, i.e., at the same timing with that of the sustain pulse $P_{SX}$ of the X electrode 5 in the address period. The reset pulse $P_R$ and the priming pulse $P_P$ each having a negative polarity are also applied to the Y electrode 4 immediately before the application of the scan pulse PAY. The reset pulse $P_R$, the priming pulse $P_P$, and the scan pulse $P_{AY}$ are set in a period having the time length of the H/3 period in the same first region.

Hereinafter, the period in which the reset pulse $P_R$, the priming pulse $P_P$, and the scan pulse $P_{AY}$ which are applied to the Y electrode 4 will be referred to as "priming/address period". In the subfield SF2, the priming/address period is set in the second region of the first H period (the priming/address period of the subfield SF1 of the line L37 is set in the first region of the subfield SF2 as shown), and the priming/address period is set in the third region of the subfield SF3 (not shown).

In each of the priming/address periods, the negative reset pulse PR is applied to the Y electrode 4 to remove the wall charges on the address electrode 6 and the Y electrode 4 which have been formed immediately before the application. Immediately after the removal, the negative priming pulse $P_p$ is applied to the Y electrode 4, so that a positive wall charge is formed on the Y electrode 4 and a negative wall charge is formed on the address electrode 6. This operation is the so-called priming. A voltage $|v_p|$ Of the priming pulse $P_P$ is set with respect to a voltage $|V_r|$ of the reset pulse $P_R$ to satisfy a relationship of:

$$|V_p| \leqq |V_r|.$$

After the priming is performed, it is impossible to generate the sustain discharge between the display electrodes 4 and 5 by the application of the sustain pulses $P_{SY}$ and $P_{SX}$. Therefore, addressing is performed in order to choose a cell to be lit (lighting cell) in the subfield SF1. In the addressing, the positive scan pulse PAY is applied to the Y electrode 4 in synchronization with the negative address pulse $P_A$ which is applied to the address electrode 6 as described above, so that a negative wall charge for producing a forward bias voltage is formed on the Y electrode 4 by the positive scan pulse $P_{AY}$ and the negative address pulse $P_A$. After that, when the negative sustain pulse $P_{SY}$ is applied to the Y electrode 4 in the cell where the wall charge is formed, the narrow pulse discharge is achieved between the display electrodes 4 and 5. In a period from after the narrow pulse discharge to the subsequent subfield SF2, the sustain pulses $P_{SX}$ and $P_{SY}$ are applied alternately to the X electrode 5 and the Y electrode 4, respectively, so that the sustain discharge is generated repeatedly to sustain the light emission from the phosphor 7.

Incidentally, in order that the cell is not lit in the subfield SF1, the voltage $V_A$ which is applied to the address electrode 6 at the same timing with that of the scan pulse $P_{AY}$ is maintained at 0V as indicated by the dotted line (0V) in the first region of the H period of the subfield SF1, and no address pulse $P_A$ is applied to the address electrode 6.

The lighting cell is chosen in the address period in the foregoing, while it is also possible to choose a cell not to be lit or an unlighting cell in the address period. In the case of choosing the unlighting cell, a positive voltage pulse is used as an address pulse $P_A$ and a positive voltage pulse is used as an priming pulse $P_P$ in the priming period to form the negative wall charge on the Y electrode 4 (the cell can be lit by the sustain pulses $P_{SX}$ and $P_{SY}$ in this state), and then a negative scan pulse $P_{AY}$ is applied to the Y electrode 4 in the address period. Thus, the Y electrode 4 is charged with a positive wall charge, and the cell is not lit by the sustain pulses $P_{SX}$ and $P_{SY}$.

Figure 2:
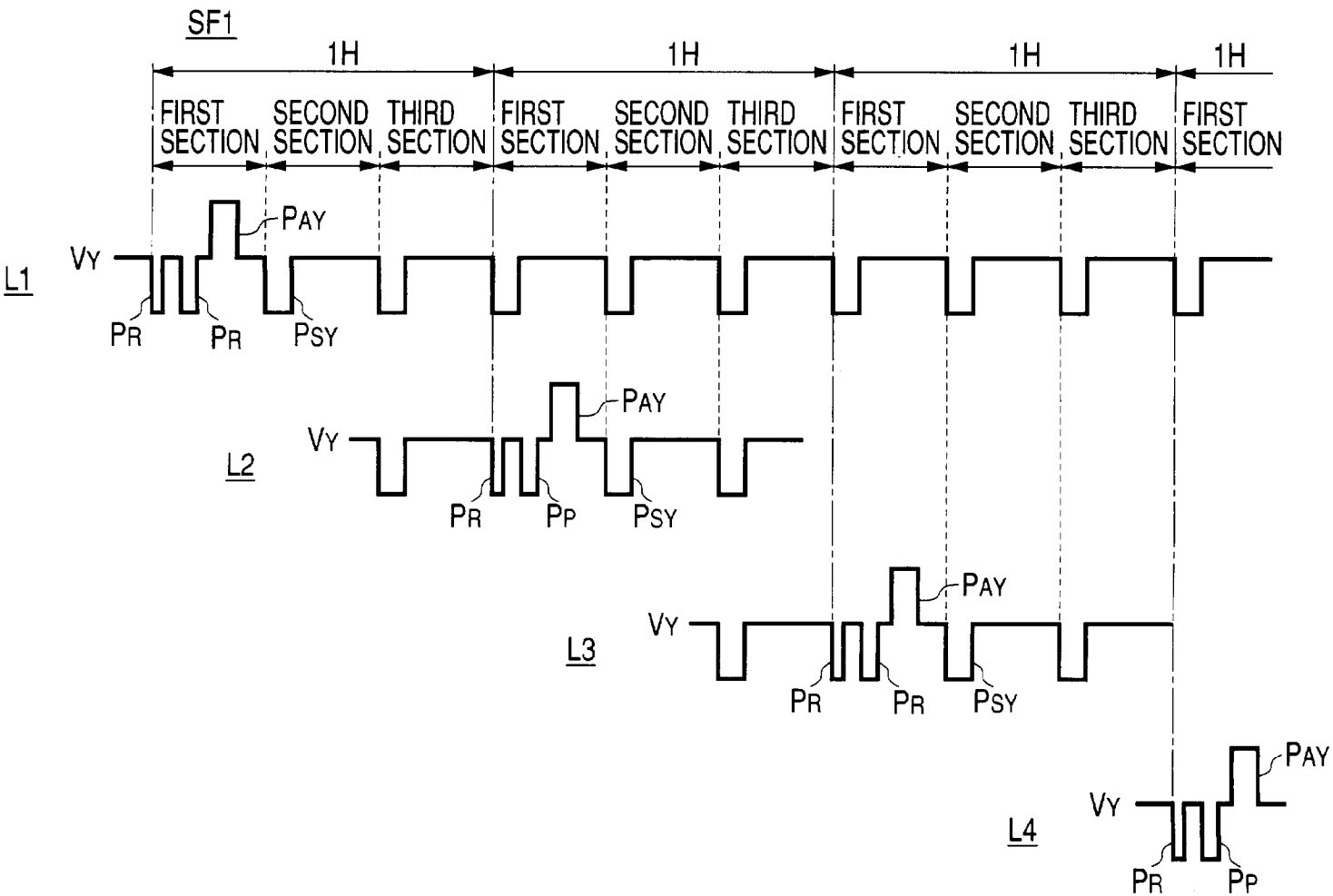
FIG. 2 is a diagram showing timings of priming/address periods in subfields SF1 of successive 4 lines in the first embodiment shown in FIG. 1.

Shown in FIG. 2 are scan timings in priming/address periods in subfields SF1 of four successive lines L1, L2, L3, and L4, where the signals and portions corresponding to those of FIG. 1 are indicated by the same symbols. In FIG. 2, only applied voltages to the Y electrodes 5 of the lines are shown to illustrate the scan timings therefor in the priming/address periods.

In FIG. 2, if the priming/address period of the line L1 is set in a first region in a first H period of the subfield SF1 of the line L1, a second H period of the line L1 falls on a first H period of the subfield SF1 of the line L2, so that the priming/address period of the line L2 is set in a first region of the second H period of the line L1. A third H period of the line L1 falls on a first H period of the subfield SF1 of the line L3, and the priming/address period of the line L3 is set in a first region of the third H period of the line L1. A fourth H period of the line L1 falls on a first H period of the subfield SF1 of the line L4, and the priming/address period of the line L4 is set in a first region of the fourth H period of the line L1. In the same manner, the priming/address periods of the subsequent lines are set with a shift of one H period per line (to be described later, it is also possible to use an mH period, wherein m is an integer of 1 or more, as an address period, to set the address periods of the sequential lines with a shift of mH period per line). Since each of the subfields SF1 consists of 37H periods, the priming/address period of the subfield SF2 of the line L1 and the priming/address period of the subfield SF1 of the line L38 fall on the same H period. Therefore, as shown in FIG. 1, the priming/address period of the line L1 is set in the second region of the H period, so that the priming/address period of the subfield SF1 of the line 38 is shifted in time from that of the line L1. In addition, referring to FIG. 1, a priming/address period (not shown) of a subfield SF3 of a preceding field of a line L113 falls on a third region of the first H period of a subfield SF2 of the line L1 as described in the foregoing with reference to FIG. 10.

Since it is possible to set both of the priming period and the address period in a region in an H period of each of the lines according to the first embodiment as described above, it is unnecessary to use an H period specially for setting the priming period. Therefore, it is possible to lengthen the sustain period to enhance the emission efficiency, thereby achieving a higher degree of brightness. Also, it is possible to set the priming period separately from the address period. More specifically, it is possible to set the priming period in a preceding H period which is immediately before the H period used as the address period or in a period having a time length of aH (a is a positive integer). In this case, the sustain period is slightly shortened as compared with the case of setting the priming period and the address period in one region, but it is possible to satisfactorily increase the duty ratio of light emission.

Figure 3:
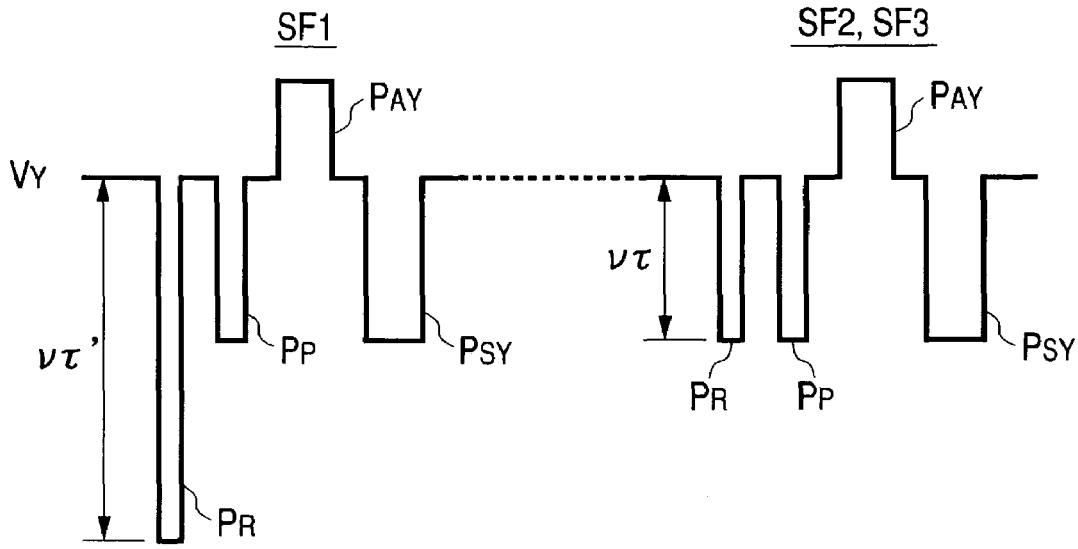
FIG. 3 is a diagram showing a main part of a method for driving a plasma display panel of a second embodiment according to the present invention, i.e., a waveform indicative of a voltage applied to a Y electrode in a priming/address period.

FIG. 3 is a diagram showing a main part of a method for driving a plasma display panel of a second embodiment according to the present invention, i.e., a waveform indicative of a voltage applied to a Y electrode 4 in a priming/address period, wherein Vγ and Vγ' are voltages of reset pulses $P_R$ and portions corresponding to those of FIG. 1 are indicated by the same symbols.

In FIG. 3, the voltage Vγ' of the negative reset pulse $P_R$ in a priming/address period in a first subfield SF1 of each of fields is larger than the voltage Vγ of the reset pulse $P_R$ (for example, the voltage Vγ' is twice the voltage Vγ) in each of the other subfields (subfields SF2 and SF3 in the present embodiment of the 3-bit 8-gradation display). For example, if the voltage Vγ of each of the reset pulses $P_R$ in the subfields other than the subfield SF1 is set to −170 V, the voltage Vγ' of the reset pulse $P_R$ in the subfield SF1 is set to about −340 V. Other parts of the configuration are the same as those of the first embodiment.

The reset pulse $P_R$ is used primarily for removing (resetting) the wall charge at least from the Y electrode 4 when the sustain period is terminated and driving of the next subfield is started, and, further, it is used also for forming a wall charge for the next addressing. For example, a short pulse of about 0.5 μsec is used as the reset pulse $P_R$ in order to perform the reset in a short time, thereby preventing the wall charge which has been removed from the Y electrode 4 from being formed again.

In the present embodiment, if charged particles which are required for forming the wall charge do not exist in the discharge space or inadequate in amount at the time of activating the plasma display panel or starting the subfields, the reset pulse $P_R$ is used also for forming the charged particles. Therefore, the voltage Vγ' of the reset pulse $P_R$ is set to be larger, as described above, in the first subfield SF1 of each of the fields to ensure the reset and the formation of wall charge. Thus, since the priming and the addressing are achieved without a reset discharge for every subfield SF, a contrast ratio of black display (unlighting cell) in the present embodiment is improved as compared with that achieved by the first embodiment.

More specifically, in the present embodiment, a voltage of the reset pulse $P_R$ in each of the subfields other than the subfield SF1 is set to a value smaller than that of the subfield SF1. If the voltage is increased too much, an intense discharge occurs to illuminate the phosphor 7. Further, if the reset pulse PR having the high voltage is used for the other fields, the number of such discharges is increased so that the phosphor emits light for every discharge, thereby degrading the contrast ratio. Since the low voltage reset pulse $P_R$ is used in each of the subfields other than the subfield SF1 to cause a weak discharge which is used only for removing the wall charges from the display electrodes 4 and 5 in the present embodiment, unnecessary emission from the phosphor 7 is suppressed to prevent the degradation in contrast ratio.

Figure 4:
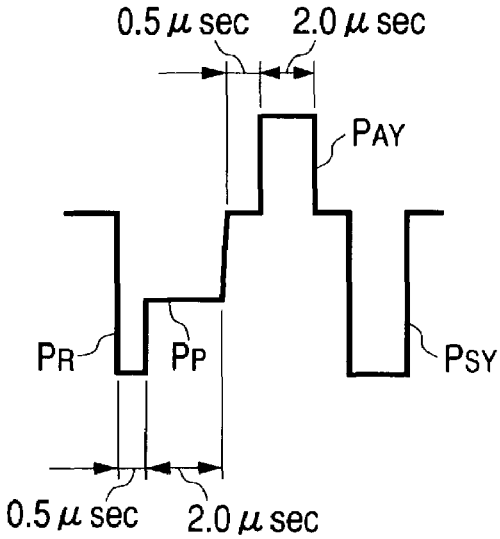
FIG. 4 is a diagram showing a main part of a method for driving a plasma display panel of a third embodiment according to the present invention, i.e., a waveform indicative of a voltage applied to a Y electrode in a priming/address period.

FIG. 4 is a diagram showing a main part of a method for driving a plasma display panel of a third embodiment according to the present invention, i.e., a waveform indicative of a voltage applied to a Y electrode 4 in a priming/address period, wherein portions corresponding to those of FIG. 1 are indicated by the same symbols.

In the third embodiment shown in FIG. 4, the voltage of the priming pulse $P_P$ in the priming/address period in each of the subfields SF is lowered and a time width of the priming pulse $P_P$ is lengthened. The priming pulse $P_P$ is shown as a pulse continuing from the reset pulse $P_R$.

The priming pulse serves to form wall charges by attracting positive charged particles in the discharge space 7 to the Y electrode 4 and attracting negative charged particles to the address electrode 6. It takes a longer time to attract the positive charged particles than to attract the negative charged particles, i.e., electrons. Therefore, in the present embodiment, the time width of the priming pulse $P_P$ is lengthened to satisfactorily attract the positive charged particles to the Y electrode 4. Further, due to the continuous application of the reset pulse $P_R$ and the priming pulse $P_P$, a charging current is eliminated to reduce a load to be applied on the circuits.

Specific values of the time lengths are such that the pulse width of the reset pulse $P_R$ is about 0.5 μsec, the pulse width of the scan pulse $P_{AY}$ is about 2.0 μsec, and the pulse width of the priming pulse $P_P$ is about 2.0 μsec as shown in FIG. 4. If the voltage of the reset pulse $P_R$ in each of the subfields other than the subfield SF1 is lowered, the discharges are weakened to reduce the space charges; therefore, in such cases, the pulse width of the priming pulse $P_P$ may be increased to about 20 to 100 μsec in order to form sufficient wall charges. In addition, the reset period and the priming period should be separated from the address period in this case.

It is possible to adopt the second embodiment into the third embodiment, that goes without saying.

Figure 5:
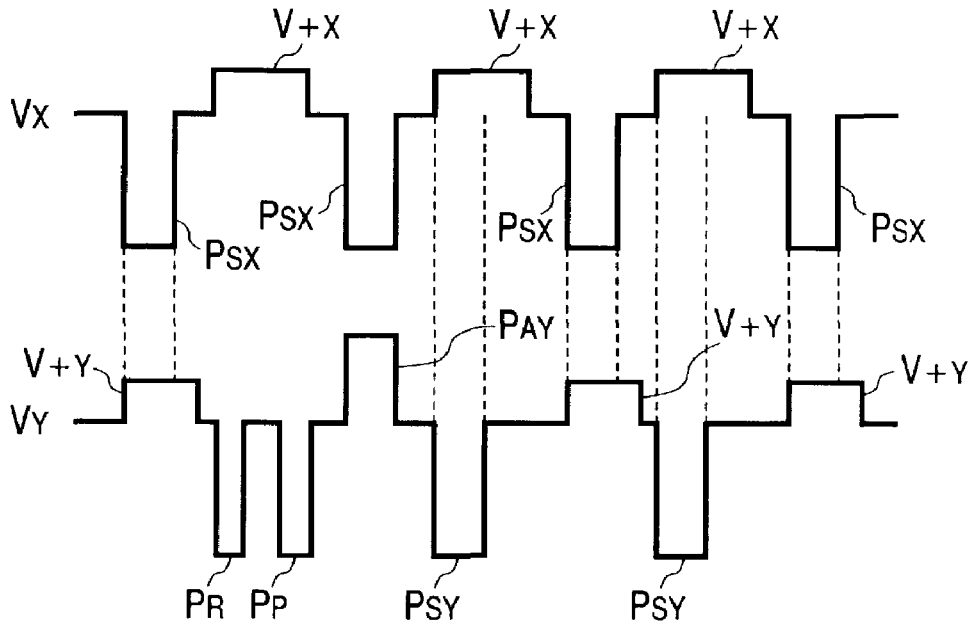
FIG. 5 is a diagram showing a main part of a method for driving a plasma display panel of a fourth embodiment according to the present invention, i.e., waveforms indicative of voltages applied to display electrodes.

FIG. 5 is a diagram showing a main part of a method for driving a plasma display panel of a fourth embodiment according to the present invention, i.e., waveforms indicative of voltages $V_Y$ and $V_X$ applied to a Y electrode 4 and an X electrode 5, wherein portions corresponding to those of FIG. 1 are indicated by the same symbols.

In the fourth embodiment shown in FIG. 5, a positive voltage pulse $V_{+Y}$ is applied to the Y electrode 4 at least during a period of application of the sustain pulse $P_{SX}$ to the X electrode 5, while a positive voltage pulse $V_{+X}$ is applied to the X electrode 5 at least during a period of application of the sustain pulse $P_{SX}$ to the Y electrode 4. Thus, it is possible to intensify a narrow pulse discharge between the display electrodes 4 and 5, thereby enabling a space charge to be used more effectively for forming a wall charge. Emission efficiency and brightness achieved by the present embodiment are improved as compared with those of the first embodiment.

In addition, it is needless to say that the present embodiment can be adopted into each of the second and third embodiments.

In the case of the plasma display panel having the configuration shown in FIG. 7B, the positive voltage pulse $V_{+Y}$ is not necessarily applied to the Y electrode 4 due to the asymmetry structure of the display electrodes 4 and 5.

Figure 6:
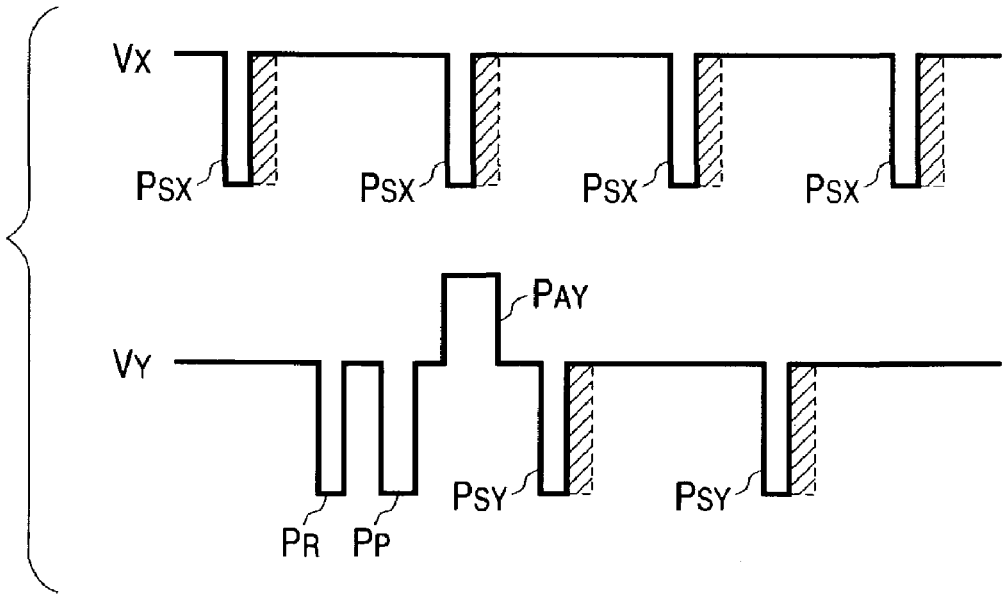
FIG. 6 is a diagram showing a main part of a method for driving a plasma display panel of a fifth embodiment according to the present invention, i.e., waveforms indicative of voltages applied to display electrodes.

FIG. 6 is a diagram showing a main part of a method for driving a plasma display panel of a fifth embodiment according to the present invention, i.e., waveforms indicative of voltages $V_Y$ and $V_X$ applied to a Y electrode 4 and an X electrode 5, respectively, wherein portions corresponding to those of FIG. 1 are indicated by the same symbols.

In the foregoing embodiments, the pulse widths of the sustain pulses $P_{SX}$ and $P_{SY}$ are respectively made equal to those of the address pulse $P_A$ and the scan pulse $P_{AY}$; however, the pulse widths of the sustain pulses $P_{SX}$ and $P_{SY}$ to be applied to the X electrode 5 and the Y electrode 4, respectively, are narrowed by excluding the hatching portions shown in FIG. 6 in the present embodiment. Each of conventional pulse widths (including a hatched part in FIG. 6) of the sustain pulses is about 2.0 μsec, whereas each of the pulse widths of the present embodiment is set to a value required for the narrow pulse discharge, which is about 0.2 to 0.5 μsec, for example.

The pulse widths of the sustain pulses $P_{SX}$ and $P_{SY}$ are narrowed as described above in order to prevent positive wall charges from being formed on the display electrodes 4 and 5. Wall charges required for the narrow pulse discharge are the negative charged particles, i.e. electrons. If a negative wall charge is formed on one of the display electrodes 4 and 5, a positive wall charge will be formed on the other display electrode. If a negative sustain pulse is applied to the Y electrode 4 in a state where the positive wall charge is formed on the X electrode 5 and the negative wall charge is formed on the Y electrode 4, the positive wall charge is removed from the X electrode 5 as being neutralized by the negative charged particles and, therefore, additional negative charged particles are required for forming a negative wall charge. More specifically, the negative charged particles attracted by the X electrode 5 are neutralized by the remaining positive wall charge to reduce an amount of the negative wall charge to be formed, thereby requiring the additional negative charged particles.

In order to prevent the above problem, an amount of each of positive wall charges to be formed on the display electrodes 4 and 5 is reduced in the present embodiment. As described above, if the negative sustain pulse Psy is applied to the Y electrode 4, the negative wall charge is formed on the X electrode 5 and the positive wall charge is formed on the Y electrode 4; however, a rate of formation of the positive wall charge is slower due to the mass of the positive charged particles. Therefore, the sustain pulse width is narrowed as described above so as to terminate the sustain pulse before a sufficient positive wall charge is formed. In the next formation of a negative wall charge on the Y electrode 4 by the use of the negative sustain pulse $P_{SX}$ applied to the X electrode 5, an amount of the positive wall charge remaining on the Y electrode 4 is reduced owing to the insufficient positive wall charge and the negative sustain pulse $P_{SX}$ applied to the X electrode 5, thereby suppressing the negative wall charge which neutralizes the positive wall charge remaining on the Y electrode 4. Therefore, it is possible to maintain a discharge with a small amount of ionization energy.

According to the present embodiment as described above, the wall charges required for achieving the narrow pulse discharge are effectively formed on the display electrodes 4 and 5, and the emission efficiency and the brightness are improved as compared with those achieved by the first embodiment shown in FIG. 1.

It is needless to say that the present embodiment can be adopted into other embodiments of the present invention.

The forgoing descriptions of the embodiments of the present invention are based on the 3-bit 8-gradation display; however, the present invention is not limited thereto. For example, in the case of 8-bit 256-gradation display, a first H period of each of subfields SF1 to SF8 is divided into 8 regions (first region to eighth region in the order of time), and a priming/address period is set in one of the regions of each of the subfields of each of the lines with the shift of 1 region per subfield, such that the priming/address period is set in the first region in the subfield SF1 and the priming/address period is set in the eighth region in the eighth subfield SF8. As described above, it is possible to separate the priming period from the address period. A cycle of repeating the sustain pulses $P_S$ is ⅛ of the horizontal synchronizing signal cycle $T_H$. Further, a cycle having a time length of $aP_S$ (a is an integer) may be used as the repeating cycle if the timings of the waveforms of the subfields are properly adjusted.

EFFECT OF THE INVENTION

As described above, according to the driving method of the present invention, the sustain period is lengthened to improve the emission efficiency in the narrow pulse discharge, thereby achieving a higher degree of brightness.

According to the present invention, since the voltage of the reset pulse in one field is made larger than that of the priming pulse, it is possible to ensure formation of a sufficient wall charge which is required for the sustain discharge, thereby realizing a stable operation. Further, since the subfield in which the voltage of the reset pulse is to be increased is specified in the field and the voltages of the reset pulses in other subfields are suppressed, it is possible to suppress unnecessary emissions by suppressing the discharges in the reset period, thereby achieving an excellent contrast.

According to the present invention, since it is possible to effectively lengthen the priming pulse for generating wall charges having desired polarities on the display electrodes, a stable operation is realized. It is also possible to reduce a circuit load by reducing a charging current owing to the reset pulse and the priming pulse which are applied continuously.

According to the present invention, since a positive voltage is applied to one of the display electrodes during a period in which a negative sustain pulse is applied to the other display electrode, wall charges are formed effectively on the display electrodes to improve emission efficiency and brightness.

According to the present invention, since a pulse width of the sustain pulse is shortened to the extent in which at least the narrow pulse discharge is possible during a period of discharge, it is possible to suppress the positive wall charge neutralization effect which is otherwise enhanced by the formations of positive wall charges on the display electrodes and, therefore, the wall charges required for the sustain discharge of the display electrodes are effectively formed to realize improvements in emission efficiency and brightness.

In order to facilitate the understanding of the drawings, major reference numerals and symbols are specified in the following.

1: front substrate, 2: back substrate, 3: partition, 4: Y electrode, 5: X electrode, 6: address electrode, 7: phosphor, 8: discharge space, 9: partition, $P_{SX}$: sustain pulse for X electrode, $P_{SY}$: sustain pulse for Y electrode, $P_A$: address pulse, $P_R$: reset pulse, $P_P$: priming pulse, $P_{AY}$: scan pulse, $V_{+X}$: positive voltage pulse for X electrode, and $V_{+Y}$: positive voltage pulse for Y electrode.

What is claimed is:

1. A method for driving a plasma display panel for achieving an n-bit gradation display, comprising:

dividing each field of each line into n subfields (n is a positive integer) of a least 2;

dividing a first H period (H is a horizontal scan period) of each of the subfields into n equal regions;

setting an address period in one of the regions of each of the subfields, the regions in which the address periods are set being different from one another in time order; and setting a time length of each sustain pulse applied in a sustain period which is subsequent to the region where the address period is set, to be 1/n times or k/n (k is an integer of 2 or more) times that of the H period, wherein a priming period which is precedent to the address period is set in the region in which the address period is set in each of the subfields.

2. The method for driving a plasma display panel according to claim 1, wherein a reset period for removing a wall charge from a display electrode is set in a period which is precedent to the priming period and in the region where the address period is set; and a voltage of the reset pulse in the reset period is set to be larger in a specific one of the subfields than those in the other subfields in each field.

3. The method for driving a plasma display panel according to claim 2, wherein a priming pulse in the priming period has a waveform which is continuous from that of the reset pulse.

4. The method for driving a plasma display panel according to claim 3, wherein a voltage $|v_r|$ of the reset pulse and a voltage $|v_p|$ of the priming pulse have a relationship of $|v_r| \geqq |v_p|$.

5. The method for driving a plasma display panel according to claim 2, wherein the plasma display panel has metal partitions which are used as partitions for cells, and the sustain pulse and the reset pulse are negative voltage pulses which are used for achieving a narrow pulse discharge between display electrodes.

6. The method for driving a plasma display panel according to claim 1, wherein a lighting cell in which a sustain discharge is performed during the sustain period is chosen by:

setting a priming pulse in the priming period to be a negative voltage pulse;

setting an address pulse which is applied to the address electrode in the address period to be a negative voltage pulse; and setting a scan pulse which is applied to one of the display electrodes to be a positive voltage pulse.

7. The method for driving a plasma display panel according to claim 1, wherein an unlighting cell in which a sustain discharge is not performed during the sustain period is chosen by:

setting a priming pulse in the priming period to be a positive voltage pulse;

setting an address pulse which is applied to the address electrode in the address period to be a positive voltage pulse; and setting a scan pulse which is applied to a display electrode to be a negative voltage pulse.

8. The method for driving a plasma display panel according to claim 1, wherein a positive voltage pulse is applied to a display electrode during a period in which a sustain pulse is applied to the other display electrode in the sustain period.

9. The method for driving a plasma display panel according to claim 1, wherein a pulse width of the sustain pulse is set to a width shorter than that of an address pulse in the address period.

10. The method for driving a plasma display panel according to claim 1, wherein the plasma display panel has a structure in which a front substrate is provided with one of a pair of display electrodes and a back substrate is provided with the other display electrode and an address electrode.

11. The method for driving a plasma display panel according to claim 1, wherein the plasma display panel has a structure in which a back substrate is provided with a pair of display electrodes which are in parallel with each other and an address electrode which is perpendicular to the display electrodes, and a discharge space in the cell is provided with a metal partition projecting from a portion between the display electrodes.

* * * * *